US005208575A

United States Patent [19]

Temple

[11] Patent Number: 5,208,575

[45] Date of Patent: May 4, 1993

[54] APPARATUS FOR COORDINATED TRIGGERING OF CHEMICALLY AUGMENTED ELECTRICAL FUSES

[75] Inventor: Victor Temple, Clifton Park, N.Y.

[73] Assignee: General Electric Company, Malvern, Pa.

[21] Appl. No.: 818,923

[22] Filed: Jan. 10, 1992

[51] Int. Cl.[5] ..... H01H 37/76; P42C 19/00

[52] U.S. Cl. ..... 337/401; 102/201

[58] Field of Search ..... 337/401, 406

[56] References Cited

U.S. PATENT DOCUMENTS

| | | | |
|---|---|---|---|
| 3,715,988 | 2/1973 | Bares | 102/80 |
| 3,726,195 | 4/1973 | Wagner et al. | 354/142 |
| 4,343,242 | 8/1982 | Welk | 102/201 |
| 4,677,412 | 6/1987 | Sibalis | 337/401 |
| 5,022,324 | 6/1991 | Rice | 102/201 |
| 5,036,588 | 8/1991 | Cherry | 30/180 |

*Primary Examiner*—Donald A. Griffith

*Attorney, Agent, or Firm*—Henry J. Policinski; William H. Murray

[57] ABSTRACT

A chemically augmented electrical fuse is triggered using optical energy acquired as a result of the triggering of another chemically augmented fuse. Light energy created as a result of the detonation of the first chemically augmented fuse is conducted to an exothermic pellet of a second fuse. The light energy received at the second fuse is focused on the exothermic pellet by means of a lens. The focused light energy causes the detonation of the exothermic pellet in the second fuse thereby causing the interruption of current through that fuse.

15 Claims, 4 Drawing Sheets

APPARATUS FOR COORDINATED TRIGGERING OF CHEMICALLY AUGMENTED ELECTRICAL FUSES

BACKGROUND OF THE INVENTION

This invention relates to current interrupters for use in electrical power distribution systems and particularly to chemically augmented fuses.

Electrical fuses provide a relatively inexpensive means of current interruption in a large variety of applications. For example, fuses can be utilized in multiphase electrical power distribution systems to interrupt current on the occurrence of a fault. Interruption of current protects the transmission lines as well as the equipment connected thereto.

It is desired that current interruption devices operate for a variety of abnormal conditions, such as, for example, hot oil in a transformer, high pressure inside a transformer tank, or the failure of a secondary protective device such as a circuit breaker or other fuse. In multiphase electrical power transmission systems, it is desirable that current is interrupted in all three phases upon the occurrence of a fault in a single one of the phases. This prevents "single phasing" of connected equipment and the associated risk of damage. It is also desirable that an external signal, derived for example from a secondary protection relay scheme, be capable of causing a fuse to operate and interrupt a circuit containing one or more fuses independent of the current flowing through the fuses.

SUMMARY OF THE INVENTION

It is therefore an object of the present invention to provide an apparatus for triggering a fuse independent of the current flowing through the fuse.

It is another object of the present invention to provide an apparatus for triggering a chemically augmented electrical fuse independent of the current flowing through the fuse.

It is still another object of the present invention to provide an apparatus for triggering a chemically augmented electrical fuse upon occurrence of a triggering event which is independent of the current through that fuse.

It is yet another object of the present invention to provide an apparatus for the coordinated triggering of fuses in a multi-phase electrical power distribution system in order to prevent single phasing.

These and other objects of the present invention are obtained by providing an apparatus for triggering chemically augmented electrical fuses, which apparatus comprises means for detecting the occurrence of a triggering event and generating light energy as a result thereof; means for receiving the light energy and providing a trigger output as a result thereof; means for coupling the light energy from the detecting means to the receiving means; and means responsive to the trigger output for providing a triggering stimulus to the fuse.

In a preferred embodiment of the invention, the apparatus comprises means for coupling light energy from a triggering source, for example detonation of exothermic material in a first fuse, through focussing means, to the exothermic material in a second fuse, thereby causing detonation of that material and interruption of the current flowing through the second fuse.

In an alternate preferred embodiment of the invention, the apparatus comprises a mechanical linkage connected between at least two fuses. The mechanical linkage comprises, for example, a rigid insulating member which is mechanically connected to a transducer for converting mechanical motion into an electrical voltage, such as a piezoelectric element. A shock wave created by the detonation of exothermic material in a first, or triggering, fuse is mechanically transmitted through the rigid insulating member to a piezoelectric element in the second, or triggered, fuse which in turn generates an electrical signal which causes an igniter to fire a body of exothermic material in the triggered fuse, thereby interrupting current flow through the triggered fuse. Alternatively, the force transmitted by means of the rigid insulating member may be used to directly sever the current carrying element in the triggered fuse thereby interrupting current flow therethrough.

Other objects, features and advantages of the present invention will be more fully apparent from the following detailed description of the preferred embodiment, the appended claims and the accompanying drawings.

DESCRIPTION OF PREFERRED EMBODIMENT

Figure 1:
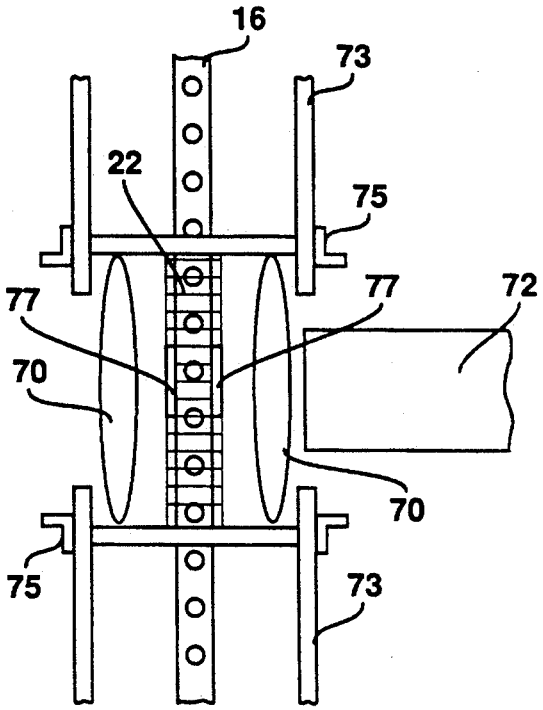
FIG. 1 is a fragmentary sectional view of a preferred embodiment of the apparatus in accordance with the present invention employing direct optical triggering.

Referring now to FIG. 1, there is shown a preferred embodiment of the present apparatus utilizing direct optical coupling. In this embodiment, a lens 70 is disposed between the end of a fiber optic cable 72 which is disposed through an opening in the fuse jacket 73 and an externally triggerable pellet of exothermic material 22 or a pellet 77 of exothermic material specially adapted for optical ignition, which pellet is positioned adjacent the pellet 22. The end of the fiber optic cable 72 is held in position with respect to the lens 70 by, for example, by a collar 75 which is attached to the fuse jacket 73. The lens 70 can either focus light emanating from the fiber optic cable onto the pellet 22 and/or the pellet 77 of exothermic material in order to detonate that material or it can serve to focus light generated by the detonated exothermic material into the fiber optic cable for transmission to a remote light detector or other fuse. In other words, the lens 70 can either focus light onto or from the exothermic material.

Figure 2:
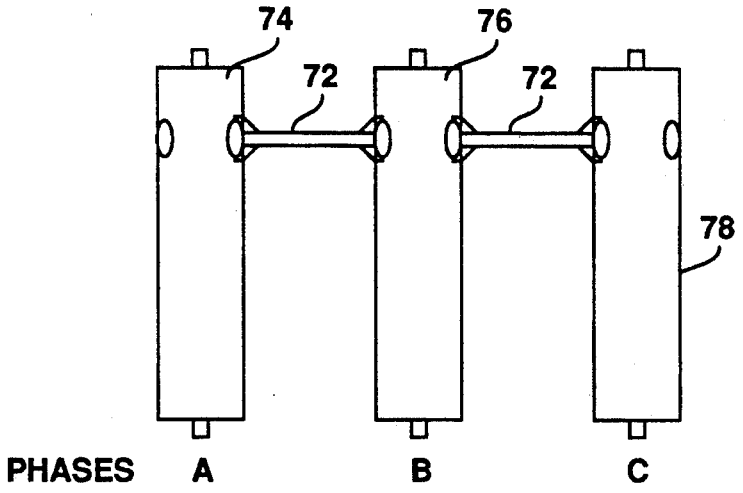
FIG. 2 is a diagrammatic representation of three fuses in a multi-phase electrical power system employing direct optical coordinated triggering of chemically augmented electrical fuses in accordance with the present invention.

FIG. 2 depicts three fuses, one associated with each of the phases in a three-phase electrical power system, which are interconnected by fiber optic cables 72 and which are constructed in accordance with the embodiment of the present invention depicted in FIG. 1. In operation, a fault in phase A, for example, would cause the detonation of the exothermic pellets in the phase A fuse 74 which would open the current carrying element of that fuse as described in the previously incorporated reference in U.S. Pat. Nos. 4,638,283, 4,489,301, 4,486,734 and 4,357,588. This in turn causes the detonation of the externally triggered pellet 22 of that fuse. Detonation of pellet 22 causes the generation of light which is coupled to a second fuse 76 in the B phase thereby triggering that fuse as described above. Triggering of the second fuse 76 creates light which is coupled to a third fuse 78 in the C phase, thereby triggering that fuse. In this way, a fault on a single phase causes the operation of the fuses in all three phases.

Figure 3:
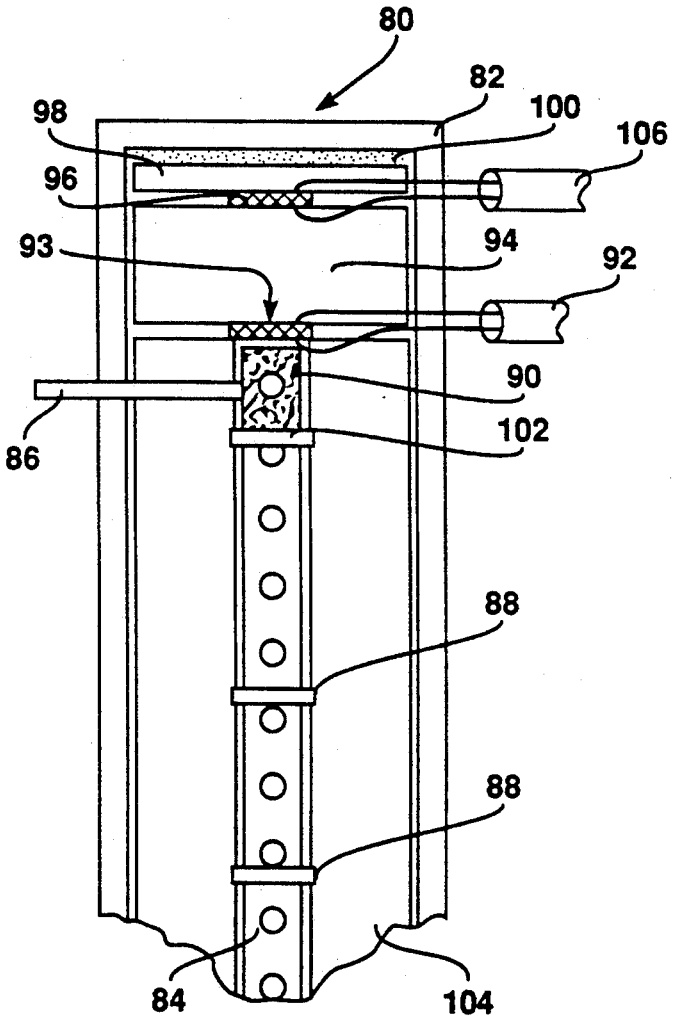
FIG. 3 is a fragmented sectional view of an alternate preferred embodiment of the apparatus of the present invention wherein coordinated triggering of fuses is initiated electromechanically.

Referring now to FIG. 3, there is shown an alternate preferred embodiment of the apparatus of the present invention, generally designated 80. The apparatus 80 comprises a housing 82 in which is disposed a current carrying element 84. Fuse current terminals 86 (only one shown in FIG. 5) are disposed through the housing 82 and are electrically connected to the ends of the current carrying element 84. Pellets of exothermic material 88 are attached to the current carrying element 84 at spaced intervals. An externally triggered pellet of exothermic material 90 is disposed at one end of the current carrying element 84. A voltage trigger input circuit 92 is connected to an ignitor element 93 which is disposed in detonating relationship with respect to the pellet 90.

A first rigid member 94, preferably constructed of an electrically insulating material such as quartz or bakelite for example, is disposed within the housing 92 adjacent an end of the current carrying element 84. A mechanical motion to electrical voltage transducer, such as a piezoelectric crystal 96, is disposed between the first rigid member 94 and a second rigid member 98, also constructed of an electrically insulating material, such as quartz or bakelite for example.

Reasonable care must be taken to ensure that the piezoelectric receiver is not activated by thermal expansion mismatches. This can be done by ensuring that the apparatus holding the three phases of the fuse holder and the rods and fuses have net effectively equal expansion. This can be taken care of in the holder or in the members 94 and 98 by constructing these members partly from low expansion materials, for example quartz of other glasses and partly from high expansion coefficient materials, for example metals. Alternatively, the members 94 and 98 could be loosely held counting on the explosive energy to shoot the member against the piezoelectric receiver. The second mode could cause one to consider the chemical energy to correct (or right) member mass ratio to be high so as to have a suitably small mechanical delay.

Shock wave absorbing media, such as sand 100, is disposed between the second rigid member 98 and the end of the housing 82. In the preferred embodiment, a shock wave deflecting disc 102 is disposed around the current carrying element 84 within the housing 82 to deflect the shock waves created by the detonation of the externally triggered pellet 90 toward the first rigid member 94. If required, an inner fuse casing 104 may be disposed within the housing 82 around the current carrying element 84.

The apparatus 80 operates as follows. The externally triggered pellet of exothermic material 90 is detonated either by the detonation of the pellets 88 or by a voltage trigger signal applied to the igniter element 93 by means of the voltage trigger input circuit 92. Detonation of the pellet 90 generates a shock wave which impinges upon the first rigid member 94. The first rigid member 94 transmits the shock wave to the piezoelectric crystal 96 which converts the motion caused by the shock wave into an electrical voltage which is coupled to a remote sensor or the voltage trigger input circuit 92 of another fuse by way of a voltage output cable 106. When used in a three phase electrical power system, a fault on one phase will cause the operation of the fuse associated with that phase which in turn will cause the generation of an electrical voltage by the piezoelectric crystal which is coupled to the voltage trigger input circuit of a fuse on a second phase, triggering that fuse. This causes the generation of a voltage which is coupled to the voltage trigger input circuit of a third fuse associated with the third phase, thereby triggering that fuse also. Consequently, a fault on a single phase will cause the operation of the fuses associated with all three phases thereby preventing single phasing.

Figure 4:
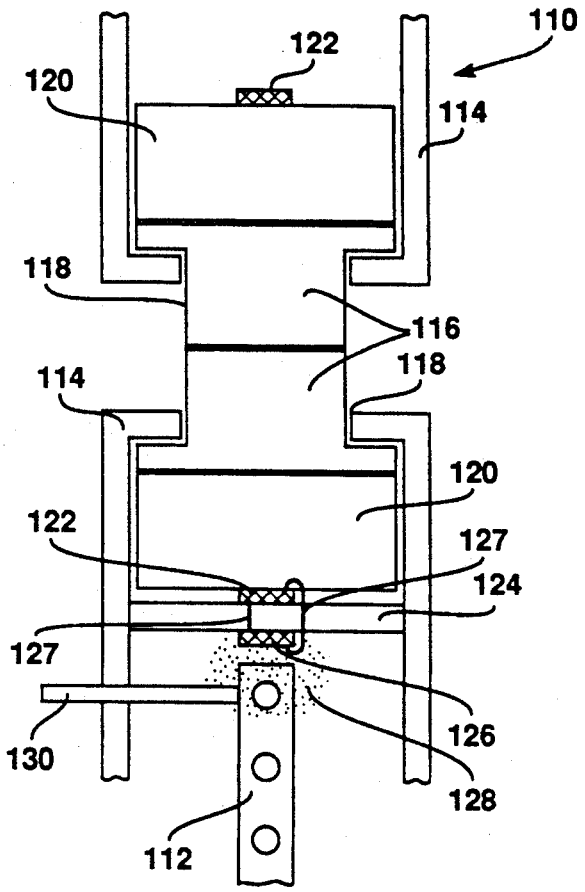
FIG. 4 is a fragmented sectional view of yet another alternate preferred embodiment of the apparatus of the present invention employing mechanical coupling for coordinated triggering of chemically augmented electrical fuses.

Referring now to FIG. 4, there is shown another alternate preferred embodiment of the present invention, generally designated 110. The apparatus 110 includes a current carrying element 112 disposed within an outer jacket 114. A force transmitting piston 116 extends through an aperture 118 in the end of the outer jacket 114. A first rigid insulating member 120 is slidably disposed within the outer jacket 114 adjacent the inner end of the piston 116. A transducer which converts mechanical motion to an electrical voltage, such as a piezoelectric crystal 122, is disposed between the first rigid insulating member 120 and a second rigid insulating member 124. An igniter element 126 is disposed between the second rigid insulating member 124 and an external triggered pellet of exothermic material 128 which is attached to one end of the current carrying element 112. The electrical voltage output from the piezoelectric crystal 122 is coupled to the ignitor element 126 by, for example, wires 127. Fuse current terminals 130 (only one shown) extend through the outer jacket 114 and are electrically connected to the ends of the current carrying element 112.

Figure 5A:
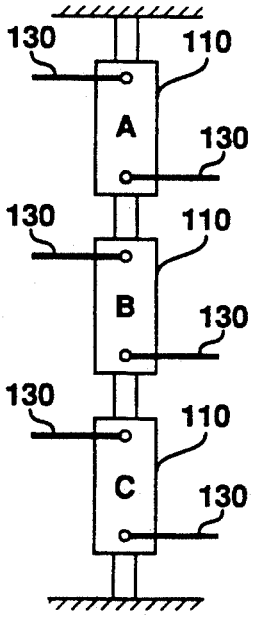
FIGS. 5A and 5B are diagrammatic representations of fuses in a three-phase power system which are mechanically coupled in series, FIG. 5A, and in parallel, FIG. 5B, for coordinated triggering in accordance with the embodiment depicted in FIG. 6.
Figure 5B:
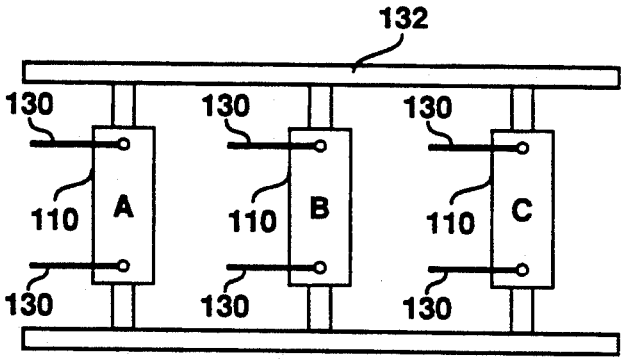

As shown in FIG. 5, the fuses 110 may be connected mechanically either in a series (FIG. 5A) or in a parallel (FIG. 5B). FIG. 4 depicts the relationship of the fuses when connected mechanically in series. Operation of the fuses when so connected is as follows. Triggering of one fuse, for example that associated with phase B, will cause the detonation of the externally triggered pellet 128. This creates a shock wave which is transmitted through the adjacent pistons 116. This causes the compression of the piezoelectric crystal 122 in the adjacent fuse which then creates a voltage. Since the piezoelectric crystal output is electrically connected to the igniter element 126, a voltage output from the crystal 122 causes the igniter 126 to ignite thereby detonating the externally triggered pellet 128. This causes the detonation of other pellets attached to the current carrying element 112 thereby causing multiple breaks in the element. In the parallel mechanical connection depicted in FIG. 7B, the shock waves are transmitted from the piston 116 of one fuse to the pistons 116 of the other fuses by means of a rigid connector bar 132 mechanically connecting the pistons 116 of all three fuses. Transmission of the shock waves through the pistons causes triggering of the fuses as described above.

Figure 6A:
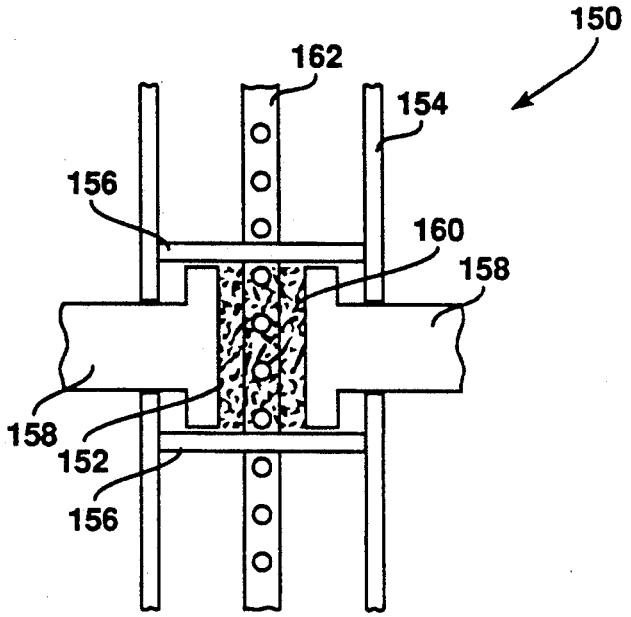
FIGS. 6A and 6B depict fragmented sectional views of an apparatus in accordance with the present invention utilizing mechanical coupling to effect coordinated triggering of fuses in a multi-phase electrical power system.

Referring now to FIG. 6, there is shown a further alternate preferred embodiment of the apparatus of the present invention, generally designated 150. In this embodiment, a sending chamber 152 is formed within a fuse housing 154 as shown in FIG. 6A. The sending chamber 152 is formed by a pair of spaced apart housing discs 156. A pair of moveable pistons 158 are slidably disposed through the fuse housing 154 and are preferably spaced 180° apart. Explosive material 160 is disposed within the sending chamber 152 between the moveable pistons 158 and around a current carrying element 162 which extends through the sending chamber 152.

Figure 6B:
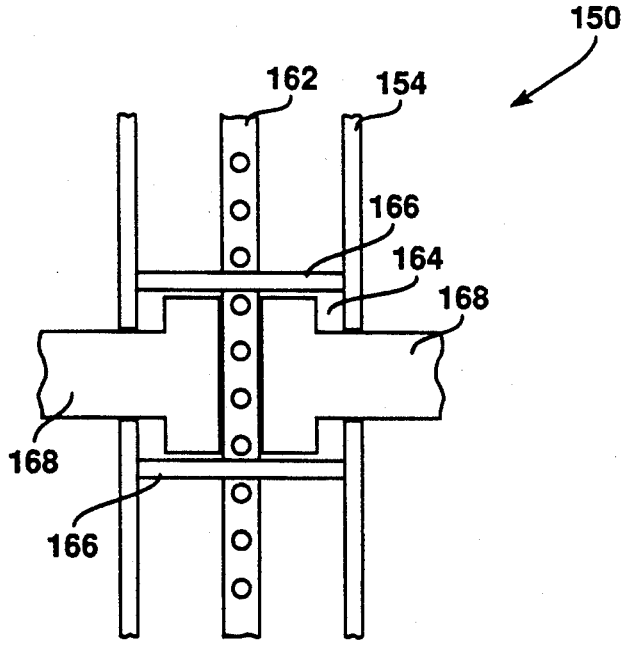

As shown in FIG. 6B, a receiving chamber 164 is formed within the housing 154 by a pair of spaced apart housing discs 166. A pair of shearing pistons 168 are slidably disposed within the receiving chamber 164 through the housing 154. The current carrying element 162 extends through the receiving chamber 164 between cutting surfaces disposed on the opposing faces of the pistons 168.

The apparatus 150 operates as follows. The exploding force, caused by the detonation of the exothermic material 160 in the sending chamber 152 of the fuse in the fault current path, causes the outward movement of pistons 158. At least one piston 158 is mechanically connected to at least one shearing piston 168 of a second fuse. As a result, the outward movement of piston 158 activates the connected shearing piston 168 in the receiving chamber 164 of the second fuse, severing the current carrying element 162. For explosive material in the sending chamber 160 that can be activated by pressure, the connection can be from the sending chamber 152 of the first fuse to the sending chamber 152 of the second fuse, thereby eliminating the need for a receiving chamber and shearing pistons.

As can be seen from the above detailed description, the apparatus of the present invention for triggering chemically augmented electrical fuses, provides rapid, synchronous triggering of fuses in a multi-phase electrical power system, thereby preventing single phasing. Such fuses can be located in proximity of one another or can be remote from one another, depending upon the application. Such fuses can also be triggered by external events which may include, by way of example, abnormal conditions such as hot oil in a transformer, high pressure inside a transformer tank, or the failure of a secondary protective device such as a circuit breaker or other fuses. The fuses may also be triggered by external control systems as required to protect the overall power distribution system.

It will be understood that various changes in the details, materials and arrangement of the part which have been described and illustrated in order to explain the nature of this invention, may be made by those skilled in the art without departing from the principle and scope of the invention as expressed in the following claims.

What is claimed is:

1. An apparatus for triggering chemically augmented electrical fuses, said apparatus comprising:

a) means, responsive to a signal generated upon the occurrence of a triggering event, for generating an internal triggering stimulus and mechanical energy;

b) means for receiving said mechanical energy and providing a trigger output signal as a result thereof; and c) means for coupling said mechanical energy from said generating means to said receiving means.

2. The apparatus in accordance with claim 1 wherein said generating means comprises a pellet of exothermic material.

3. The apparatus in accordance with claim 2 wherein said receiving means comprises a transducer for converting mechanical motion to an electrical voltage.

4. The apparatus in accordance with claim 3 wherein said transducer comprises a piezoelectric crystal.

5. The apparatus in accordance with claim 3 wherein said coupling means comprises a rigid insulating member.

6. A system for coordinated triggering of fuses, said system including at least two fuses, each fuse comprising:

a) means for receiving light energy from an external source generated at a result of a triggering event;

b) means, responsive to said external source of light energy, for generating an internal triggering stimulus and light energy; and c) means for coupling said internally generated light energy to light energy receiving means of another of said at least two fuses.

7. The system in accordance with claim 6 wherein said means for generating an internal triggering stimulus and light energy comprises a pellet of exothermic material.

8. The system in accordance with claim 6 wherein said light energy receiving means comprises a lens for focussing said light energy onto said means for generating an internal triggering stimulus and light energy.

9. The system in accordance with claim 8 wherein said coupling means comprises fiber optic cable having a first end and a second end, said first end being disposed in proximity to the lens of one fuse of said system and said second end being disposed in proximity to the lens of another fuse of said system.

10. An apparatus for triggering chemically augmented fuses, said apparatus comprising:

a) a pellet of exothermic material for detecting the occurrence of a triggering event and generating mechanical energy as a result thereof; and b) a rigid insulating member for coupling said mechanical energy from said detecting means to a guillotine means, coupled to an end of said rigid insulating member, for severing a fuse carrying element in said fuse as a result of said mechanical motion imparted to said rigid member.

11. A system for coordinated triggering of fuses, said system including at least two fuses, each fuse comprising:

a) means for receiving mechanical energy from an external source generated as a result of a triggering event;

b) means responsive to said external source of mechanical energy for generating an internal triggering signal;

c) means, responsive to said internal triggering signal, for generating an internal triggering stimulus and mechanical energy; and d) means for coupling said internally generated mechanical energy to mechanical energy receiving means of another of said at least two fuses.

12. The system in accordance with claim 11 wherein said means for generating an internal triggering signal comprises a transducer for converting mechanical motion to an electrical voltage.

13. The system in accordance with claim 12 wherein said transducer comprises a piezoelectric crystal.

14. The system in accordance with claim 12 wherein said coupling means comprises a rigid insulating member.

15. The apparatus in accordance with claim 14 wherein said means for generating an internal triggering stimulus and mechanical energy comprises a pellet of exothermic material.

* * * * *